US012760890B2

(12) United States Patent
Park et al.

(10) Patent No.: US 12,760,890 B2
(45) Date of Patent: Oct. 13, 2026

(54) LOW $NO_X$ PREMIXED HYDROGEN BURNER

(71) Applicants: Hyundai Motor Company, Seoul (KR); Kia Corporation, Seoul (KR); Inha University Research and Business Foundation, Incheon (KR)

(72) Inventors: Taeheum Park, Gunpo (KR); Hyung Jin Lee, Incheon (KR); Jong Min Shin, Incheon (KR)

(73) Assignees: Hyundai Motor Company, Seoul (KR); Kia Corporation, Seoul (KR); Inha University Research and Business Foundation, Incheon (KR)

( * ) Notice: Subject to any disclaimer, the term of this patent is extended or adjusted under 35 U.S.C. 154(b) by 371 days.

(21) Appl. No.: 18/519,922

(22) Filed: Nov. 27, 2023

(65) Prior Publication Data

US 2025/0075905 A1 Mar. 6, 2025

(30) Foreign Application Priority Data

Aug. 30, 2023 (KR) ..... 10-2023-0114849

(51) Int. Cl.
*F23D 14/62* (2006.01)
*F23D 14/58* (2006.01)

(52) U.S. Cl.
CPC ..... *F23D 14/62* (2013.01); *F23D 14/58* (2013.01); *F23D 2213/00* (2013.01); *F23D 2214/00* (2013.01)

(58) Field of Classification Search
CPC .... F01K 25/005; F23D 2213/00; F23D 14/58; F23D 14/62
USPC ..... 431/8
See application file for complete search history.

(56) References Cited

U.S. PATENT DOCUMENTS 2,941,021 A * 6/1960 Krause ..... C07C 4/04 585/539
4,698,214 A * 10/1987 Linz ..... C01G 43/01 423/261
4,797,087 A * 1/1989 Gitman ..... B05B 7/0861 239/423
4,916,904 A * 4/1990 Ramsaier ..... F22B 1/003 60/737

* cited by examiner

*Primary Examiner* — Vivek K Shirsat
(74) *Attorney, Agent, or Firm* — Fox Rothschild LLP

(57) ABSTRACT

Disclosed is a low NOx premixed hydrogen burner including: a plenum chamber including an inlet pipe and an outlet pipe and for mixing hydrogen and combustion air introduced through said inlet pipe to generate premixed gas for flame formation, in which a diameter of said plenum chamber is larger than diameters of said inlet pipe and the outlet pipe, and a length of said plenum chamber is greater than the diameter of said plenum chamber.

18 Claims, 16 Drawing Sheets

LOW $NO_X$ PREMIXED HYDROGEN BURNER

CROSS-REFERENCE TO RELATED APPLICATION

This application claims under 35 U.S.C. § 119(a) benefit of Korean Patent Application No. 10-2023-0114849 filed in the Korean Intellectual Property Office on Aug. 30, 2023, the entire contents of which are incorporated herein by reference.

BACKGROUND

(a) Technical Field

The present invention relates to a low NOx premixed hydrogen burner, and more particularly, to a low NOx premixed hydrogen burner structure capable of reducing emissions of nitrogen oxides discharged from a burner using hydrogen as fuel.

(b) Background

Around the world, various efforts are exerted to achieve carbon neutrality in production plants, and in the electricity field, electricity has been developed through various renewable energy sources. However, among automobile production plants, painting/PT plants use a large amount of energy using LNG combustion, such as ovens and booth air conditioner burners, which are directly related to greenhouse gas emissions. Therefore, in order to achieve carbon neutrality in production plants, hydrogen burners that do not produce greenhouse gas are being developed as an alternative to existing LNG burners.

However, in the case of hydrogen burners, the combustion method through the premixing method is adopted, which is relatively favorable for low NOx environmental regulations, but it is difficult to satisfy environmental regulations due to NOx generation due to the high flame temperature of hydrogen, and the stable operation area is limited due to backfire and misfire in hydrogen combustion.

SUMMARY

The present invention attempts to provide a low NOx premixed hydrogen burner structure capable of effectively reducing NOx emissions and expanding the combustion safety operation range.

An exemplary embodiment of the present invention provides a low NOx premixed hydrogen burner including: a plenum chamber including an inlet pipe and an outlet pipe and configured to mix hydrogen and combustion air introduced through the inlet pipe to generate premixed gas for flame formation, in which a diameter of the plenum chamber is larger than diameters of the inlet pipe and the outlet pipe, and a length of the plenum chamber is greater than the diameter of the plenum chamber.

The low NOx premixed hydrogen burner may further include: a hydrogen supply pipe connected to the inlet pipe of the plenum chamber and configured to be supplied with hydrogen; and a combustion air supply pipe connected to the inlet pipe of the plenum chamber, and configured to be supplied with combustion air used for combustion.

The low NOx premixed hydrogen burner may further include an outer cooling air supply pipe connected to the outlet pipe of the plenum chamber, and configured to flow outer cooling air along an outer periphery of the outlet pipe to cool the premixed gas discharged from the plenum chamber.

The plenum chamber may be formed in a cylindrical shape.

The plenum chamber may have a length-to-radius ratio (AR) of about 6.7 to about 6.9. The plenum chamber may have a length-to-radius ratio (AR) of less than about 12.9.

A diameter of the plenum chamber may be formed to be two times or more than a diameter of an upstream pipe.

The plenum chamber may be formed in a diffuser-type or nozzle-type with a different diameter between an inlet and an outlet.

The outer cooling air supply pipe may be installed in an annular shape to surround an outer periphery of the outlet pipe of the plenum chamber.

The outer cooling air supply pipe may have an inner surface coupled to an outer surface of the outlet pipe of the plenum chamber by a reducer so that cooling air supply is not biased in a particular direction.

An end of the outlet of the outlet pipe of the plenum chamber may project over an end of the outlet of the outer cooling air supply pipe by a recess length Lc, which may be formed to be minimized.

A diameter of an outlet of the outer cooling air supply pipe may be formed to generate between about 15 m/s and about 30 m/s of an air supply flow velocity.

The low NOx premixed hydrogen burner may further include an inner cooling air supply pipe installed to extend through an interior of the plenum chamber to the outlet pipe of the plenum chamber, and configured to flow outer cooling air through and cool premixed gas in the plenum chamber.

An end of an outlet of the inner cooling air supply pipe may be formed to be on the same vertical line as or to project over an end of the outlet of the outlet pipe of the plenum chamber.

An end of an outlet of the inner cooling air supply pipe may be formed in a diffuser shape.

An end of an outlet of the inner cooling air supply pipe may be formed to project by one-third or less of a length of a flame formed from an end of an outlet of the inner cooling air supply pipe over an end of an outlet of the outlet pipe of the plenum chamber.

A flow velocity and pressure of inner cooling air in the inner cooling air supply pipe may be formed to be greater than a flow velocity and pressure of hydrogen burner premixed gas at a full load.

The inner cooling air supply pipe may include a single inlet and a plurality of outlets.

In an exemplary embodiment, a low NOx premixed hydrogen burner is provided. The burner includes a plenum chamber comprising an inlet pipe and an outlet pipe and configured to mix hydrogen and combustion air introduced through the inlet pipe to generate premixed gas for flame formation. The outer cooling air supply pipe may be installed in an annular shape to surround an outer periphery of the outlet pipe of the plenum chamber. An inner cooling air supply pipe may be installed to extend through an interior of the plenum chamber to the outlet pipe of the plenum chamber.

An end of the outlet of the outlet pipe of the plenum chamber may project over an end of the outlet of the outer cooling air supply pipe. An end of an outlet of the inner cooling air supply pipe is formed to be on the same vertical line as or to project over an end of the outlet of the outlet pipe of the plenum chamber.

According to the embodiment of the present invention, it is possible to improve the mixing performance of the pre-mixture gas, and it is possible to achieve stable combustion by increasing the range of stable combustion, by stabilizing the internal flow and forming a forced vortex within the plenum chamber that generates premixed gas in which hydrogen and combustion air are mixed.

In addition, it is possible to reduce the flame hot spot and flame length by supplying outer cooling air and inner cooling air through pipes installed around the plenum chamber to cool the premixed flame.

Further, it is possible to reduce the exposure time of high-temperature areas, thereby reducing the amount of NOx generated.

DETAILED DESCRIPTION OF THE EMBODIMENTS

Figure 1:
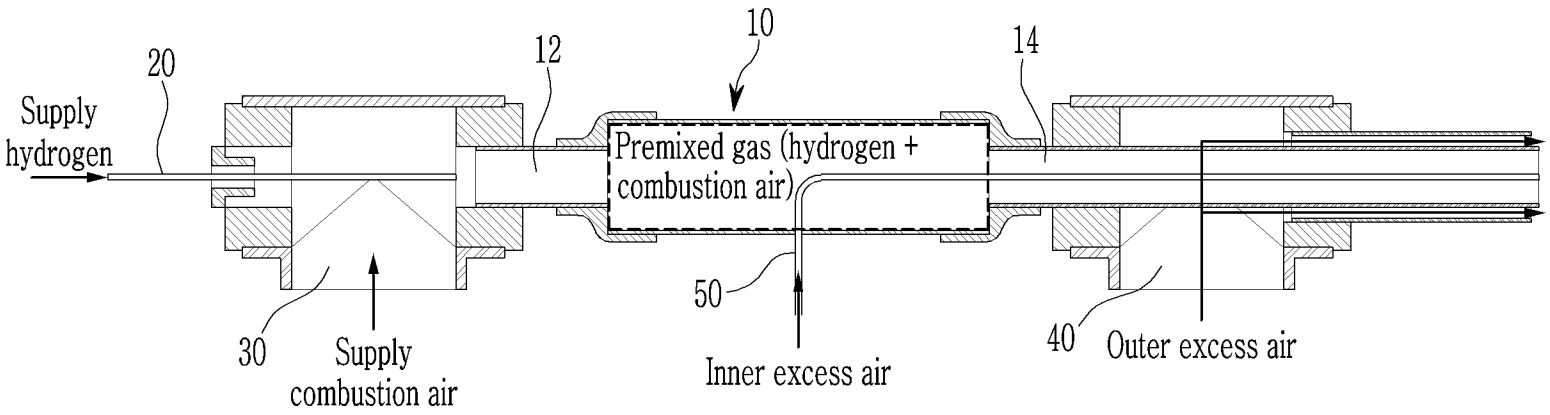
FIG. 1 is a diagram schematically illustrating a low NOx premixed hydrogen burner according to an exemplary embodiment of the present invention.

In the following detailed description, only certain exemplary embodiments of the present invention have been shown and described, simply by way of illustration. However, the present invention can be variously implemented and is not limited to the following embodiments.

Further, in several exemplary embodiments, a constituent element having the same configuration will be representatively described in one exemplary embodiment by using the same reference numeral, and other configurations different from those of the one exemplary embodiment will be described in other exemplary embodiments.

It is noted that the drawings are schematic and not drawn to scale. Relative dimensions and proportions of parts in the drawings are shown exaggerated or reduced in size for clarity and convenience in the drawing, and any dimensions are illustrative only and not limited. In addition, the same reference numerals are used to indicate like features to the same structure, element, or part appearing in two or more drawings. When a part is referred to as being "above" or "on" another part, it may be directly on the other part or the other part may be involved in between.

An exemplary embodiment of the present invention specifically illustrates one embodiment of the present invention. As a result, various modifications of the diagram are expected. Accordingly, the embodiment is not limited to a specific form of the illustrated area, and includes, for example, a form modification by manufacturing.

Hereinafter, with reference to the accompanying drawings, a low NOx pre-mixed hydrogen burner according to an exemplary embodiment of the present invention will be described in detail.

Figure 3:
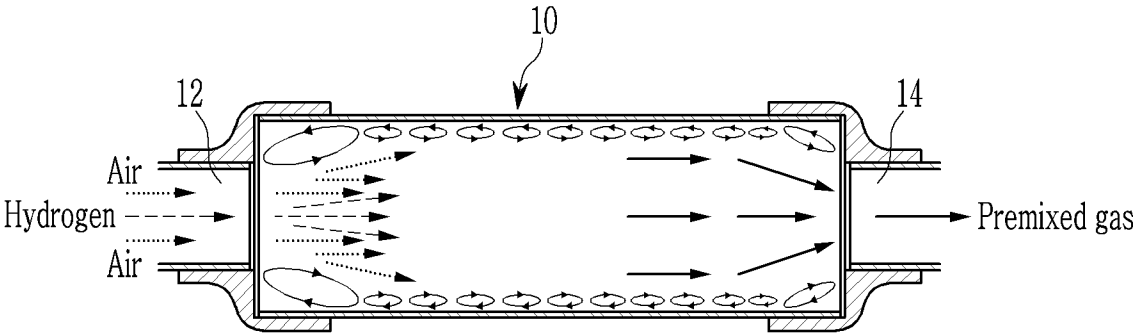
FIG. 3 is a diagram schematically illustrating the flow of premixed gas inside a plenum chamber of a low NOx premixed hydrogen burner according to the embodiment of the present invention.

FIG. 1 is a diagram schematically illustrating a low NOx premixed hydrogen burner according to an exemplary embodiment of the present invention, and FIG. 3 is a diagram schematically illustrating the flow of premixed gas inside a plenum chamber of a low NOx premixed hydrogen burner according to the embodiment of the present invention.

Referring to FIG. 1, a low NOx premixed hydrogen burner according to an exemplary embodiment of the present invention may include a plenum chamber 10.

The plenum chamber 10 may have an inlet pipe 12 into which hydrogen and combustion air flow and an outlet pipe 14 from which premixed gas in which hydrogen and combustion air are mixed is discharged. A length of the plenum chamber 10 may be set to be greater than a diameter of the plenum chamber 10.

Additionally, the plenum chamber 10 may be formed in a cylindrical shape. In the cylindrical space between the inlet pipe 12 and the outlet pipe 14, pre-mixed gas in which hydrogen and combustion air are mixed may be generated. In this case, the diameter of the plenum chamber 10 may be formed greater than the diameter of the inlet pipe 12 and the outlet pipe 14, and may be formed to be two times or more than a diameter of an upstream pipe.

The low NOx premixed hydrogen burner according to the embodiment of the present invention may further include a hydrogen supply pipe 20 connected to the inlet pipe of the plenum chamber 10, a combustion air supply pipe 30 connected to the inlet pipe of the plenum chamber 10, separately from the hydrogen supply pipe 20, and an outer cooling air supply pipe 40 connected to the outlet pipe 14 of the plenum chamber 10.

As shown in FIG. 3, inside the plenum chamber 10, hydrogen and combustion air may be introduced and mixed to form premixed gas. Within the plenum chamber 10, hydrogen and combustion air are uniformly mixed, and forced vortices are generated to form stabilized premixed gas with a constant flow velocity and pressure.

The hydrogen supply to the interior of the plenum chamber 10 may be performed by pressure, and the combustion air may be supplied by an external blower 32, so that forced vortices may be generated to stabilize the mixing and flow of the premixed gases. Furthermore, a length-to-radius ratio of the plenum chamber 10 may be set to about 6.7 to about 6.9 for generating premixed gas with a stable flow velocity and pressure.

The hydrogen supply pipe 20 may be connected to the inlet pipe 12 of the plenum chamber 10, and receive hydrogen from an external hydrogen tank 2 and supplies the received hydrogen to the interior of the plenum chamber 10. The hydrogen supply pipe 20 is disposed in a direction parallel to the inlet pipe 12 of the plenum chamber 10, and is disposed to penetrate the interior of the combustion air supply pipe 30. The outlet of the hydrogen supply pipe 20 may form the same outlet as the outlet of the combustion air supply pipe 30.

Further, the combustion air supply pipe 30 may be connected to the inlet pipe 12 of the plenum chamber 10, and receive combustion air used for combustion through the external blower 32 and supply the received combustion air to the interior of the plenum chamber 10. The combustion air supply pipe 30 is disposed perpendicular to the inlet pipe 12 of the plenum chamber 10, and may form an outlet approximately same as the outlet of the hydrogen supply pipe 20. Thus, the hydrogen supplied from the hydrogen supply pipe 20 and the combustion air supplied from the combustion air supply pipe 30 together flow to the interior of the plenum chamber 10 through the inlet pipe 12 of the plenum chamber 10.

The outer cooling air supply pipe 40 may be connected to the outlet pipe 14 of the plenum chamber 10, and may cool the premixed gas formed inside the plenum chamber 10. To this end, the outer cooling air supply pipe 40 may have outer cooling air flowing along the outer periphery of the outlet pipe 14 of the plenum chamber 10. Outer cooling air may be supplied to the outer cooling air supply pipe 40 through an external blower 42.

The outer cooling air supply pipe 40 may be annularly installed to surround around the outer periphery of the outlet pipe 14 of the plenum chamber 10. The outer cooling air supply pipe 40 may be disposed in a direction perpendicular to the outlet pipe 14 of the plenum chamber 10, and an outlet of the outer cooling air supply pipe 40 may be formed at a location approximately similar to an outlet of the outlet pipe 14 of the plenum chamber 10.

On the other hand, the plenum chamber 10 may further include an inner cooling air supply pipe 50 installed to extend through the interior of the plenum chamber 10 to the outlet pipe 14 of the plenum chamber 10. The inner cooling air supply pipe 50 may be inserted from one outer side of the plenum chamber 10 into the interior in the direction perpendicular to the longitudinal direction of the plenum chamber 10, and may be bent within the plenum chamber 10 to extend in the longitudinal direction of the plenum chamber 10. The outlet of the inner cooling air supply pipe 50 may be formed at a location approximately similar to the outlet of the outlet pipe 14 of the plenum chamber 10 and the outlet of the outer cooling air supply pipe 40.

Figure 2:
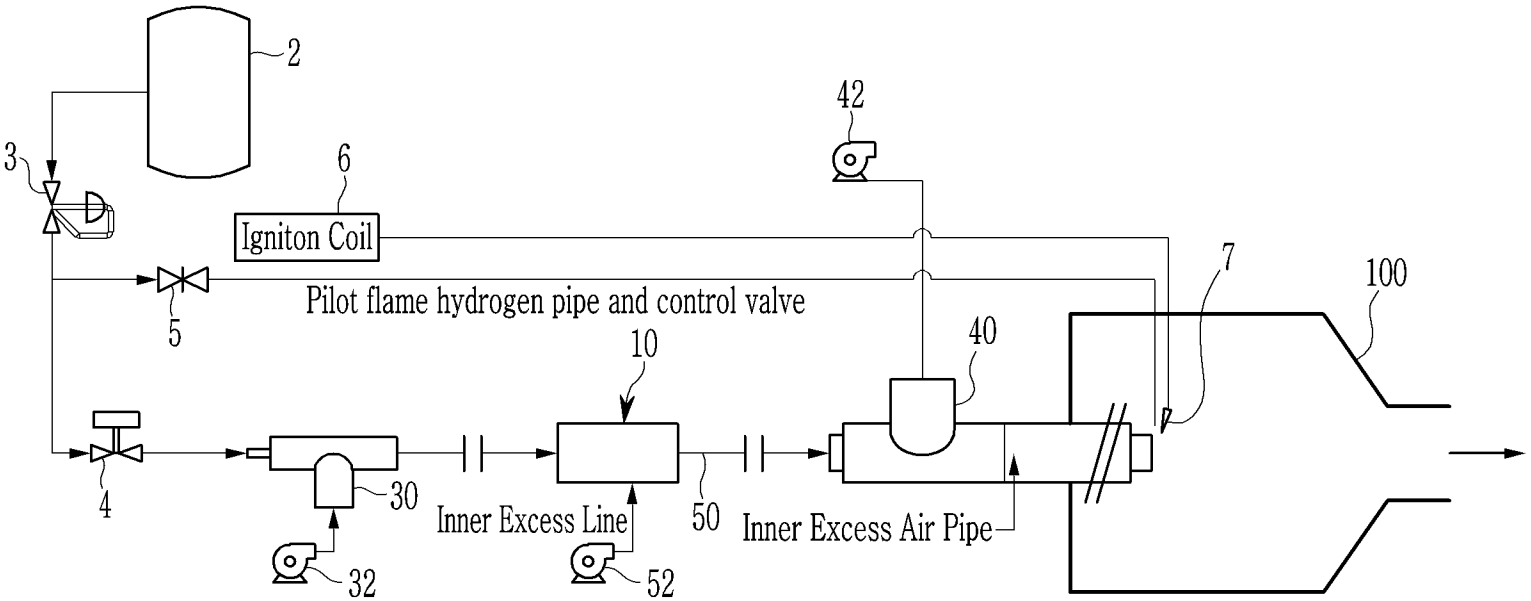
FIG. 2 is a diagram schematically illustrating a hydrogen burner system including a low NOx premixed hydrogen burner according to an exemplary embodiment of the present invention.

FIG. 2 is a diagram schematically illustrating a hydrogen burner system including the low NOx premixed hydrogen burner according to the embodiment of the present invention.

Referring to FIG. 2, the hydrogen supply pipe 20 may receive hydrogen from the hydrogen tank 2 and deliver the received hydrogen to the plenum chamber 10. In the hydrogen tank 2, a hydrogen supply regulator 3 is connectedly installed to control the hydrogen supply pressure for the hydrogen burner, and a hydrogen metering valve 5 is connectedly installed to control the flow rate of hydrogen for ignition. At a rear end of the regulator 3 and the metering valve 5, a hydrogen flow control valve 4 may be installed to control the hydrogen flow rate supplied to the plenum chamber 10.

A blower 32 may be installed in the combustion air supply pipe 30 to introduce air for combustion from the outside and deliver the introduced air to the plenum chamber 10. In addition, the blower 42 is installed in the outer cooling air supply pipe 40 to introduce outer cooling air to cool the premixed gas discharged from the plenum chamber 10. In addition, a blower 52 is installed in the inner cooling air supply pipe to introduce outer cooling air to cool the premixed gas generated within the plenum chamber 10.

The outlet of the outlet pipe 14 of the plenum chamber 10, the outlet of the outer cooling air supply pipe 40, and the outlet of the inner cooling air supply pipe 50 may be formed at approximately similar locations, at which an igniter 7 is installed to generate a spark by operation of an ignition coil 6 and hydrogen discharged through the metering valve 5. The spark reacts with the premixed gas discharged from the outlet pipe 14 of the plenum chamber 10 to form the hydrogen burner flame. The flame is then discharged to the outside through the combustion chamber 100.

Figure 4:
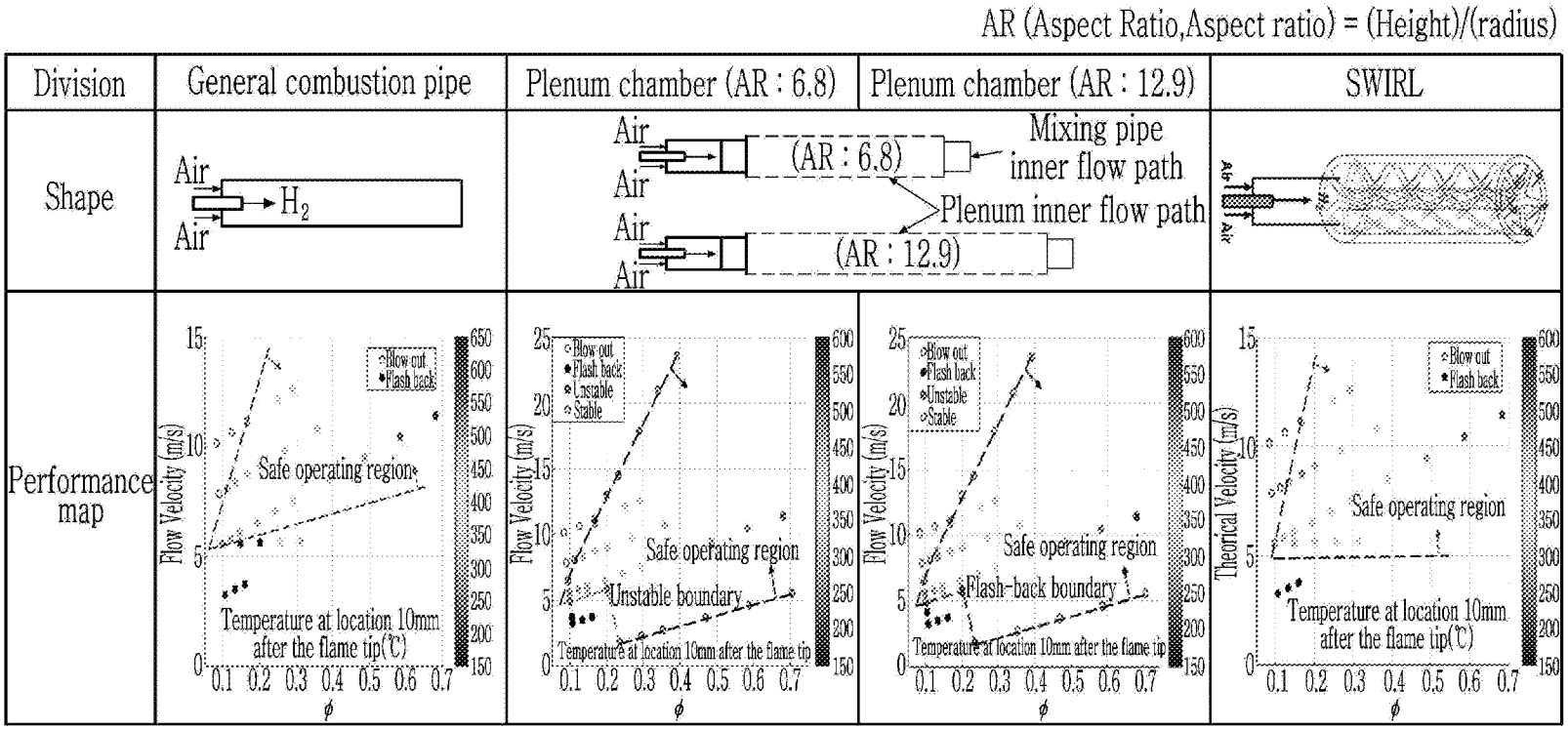
FIG. 4 is a diagram illustrating an effect of adding the plenum chamber to the low Nox premixed hydrogen burner according to the embodiment of the present invention.

FIG. 4 is a diagram illustrating an effect of adding the plenum chamber to the low NOx premixed hydrogen burner according to the embodiment of the present invention.

Referring to FIG. 4, as a result of measuring the temperature at a location about 10 mm after a tip end of the flame, and measuring whether the flame blows out or a flash back occurs, it may be measured that for the general combustion pipe without the plenum chamber 10, the safe operating region in which a flame does not blow out and a flash back does not occur is about 320° C. to about 650° C.

Furthermore, when the plenum chamber 10 is provided, and the length-to-radius ratio (AR) of the plenum chamber 10 is 6.8, the safe operating region is measured to be from about 180° C. to about 540° C., and the widest range of safe operating region may be secured, indicating that the flow stability is excellent. On the other hand, when the length-to-radius ratio (AR) of the plenum chamber 10 is about 12.9, the safe operating region is measured as a large range, but there is a risk of flash back at low load, and the size of the burner is enlarged, which limits installation.

On the other hand, when a swirl-shaped flow path is formed inside the plenum chamber 10, the gas mixing performance may be excellent, but the flow stability may be difficult to secure due to the narrow safe operating region, and it is not easy to manufacture the shape inside the plenum chamber 10.

Thus, the length-to-radius ratio (AR) of the plenum chamber 10 of the low NOx premixed hydrogen burner according to the embodiment of the present invention may be set to about 6.7 to about 6.9.

Figure 5:
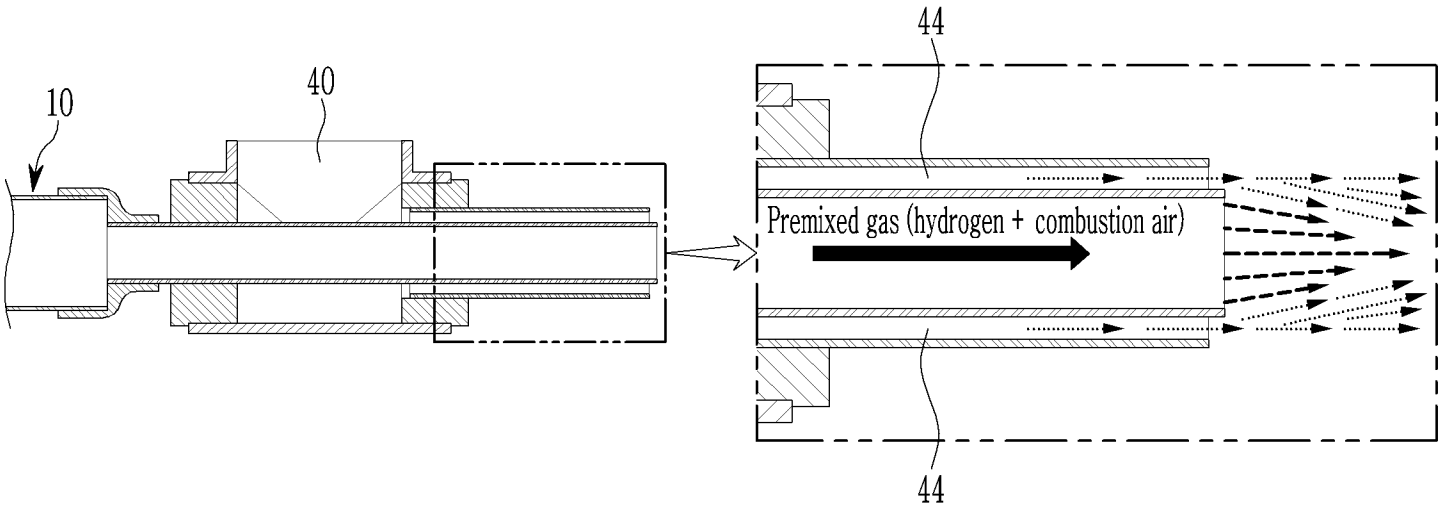
FIG. 5 is a diagram illustrating an outlet of the low Nox premixed hydrogen burner according to the embodiment of the present invention.

FIG. 5 is a diagram illustrating an outlet of the low NOx premixed hydrogen burner according to the embodiment of the present invention.

Referring to FIG. 5, the outer cooling air supply pipe 40 may include a conduit 44 annularly installed to surround an outer periphery of the outlet pipe 14 of the plenum chamber 10, and the externally supplied cooling air may travel longitudinally along the outer periphery of the outlet pipe 14 of the plenum chamber 10 to cool the premixed gas flowing along the outlet pipe 14 from inside the plenum chamber 10.

Figure 6:
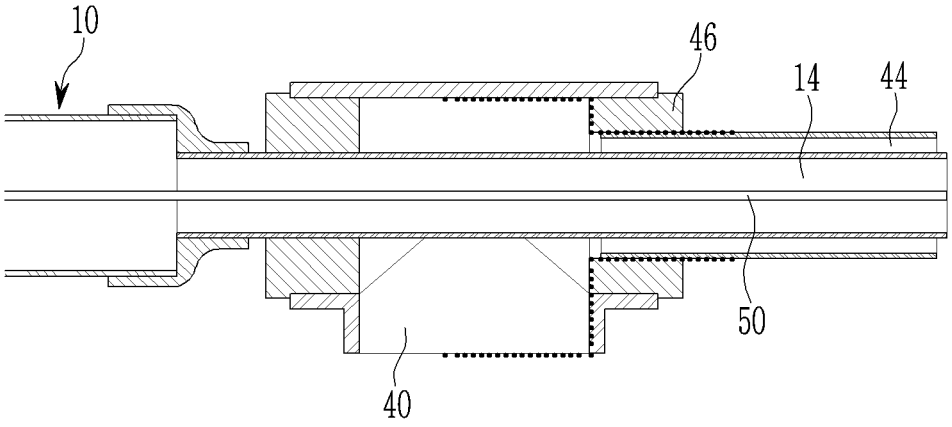
FIG. 6 is a diagram illustrating a pipe reducing state between an outer cooling air supply pipe and an outlet pipe of the plenum chamber of the low Nox premixed hydrogen burner according to the embodiment of the present invention.

FIG. 6 is a diagram illustrating a pipe reducing state between the outer cooling air supply pipe and the outlet pipe of the plenum chamber of the low NOx premixed hydrogen burner according to the embodiment of the present invention.

Referring to FIG. 6, the outlet of the outer cooling air supply pipe 40 may form the conduit 44 to be spaced apart from the outlet pipe 14 of the plenum chamber 10, and an inner surface of the outlet of the outer cooling air supply pipe 40 may be coupled to the outer surface of the outlet pipe 14 of the plenum chamber 10 by a reducer 46 so that the flow rate and flow velocity of the outer cooling air is not biased while maintaining a constant spacing.

Figure 7:
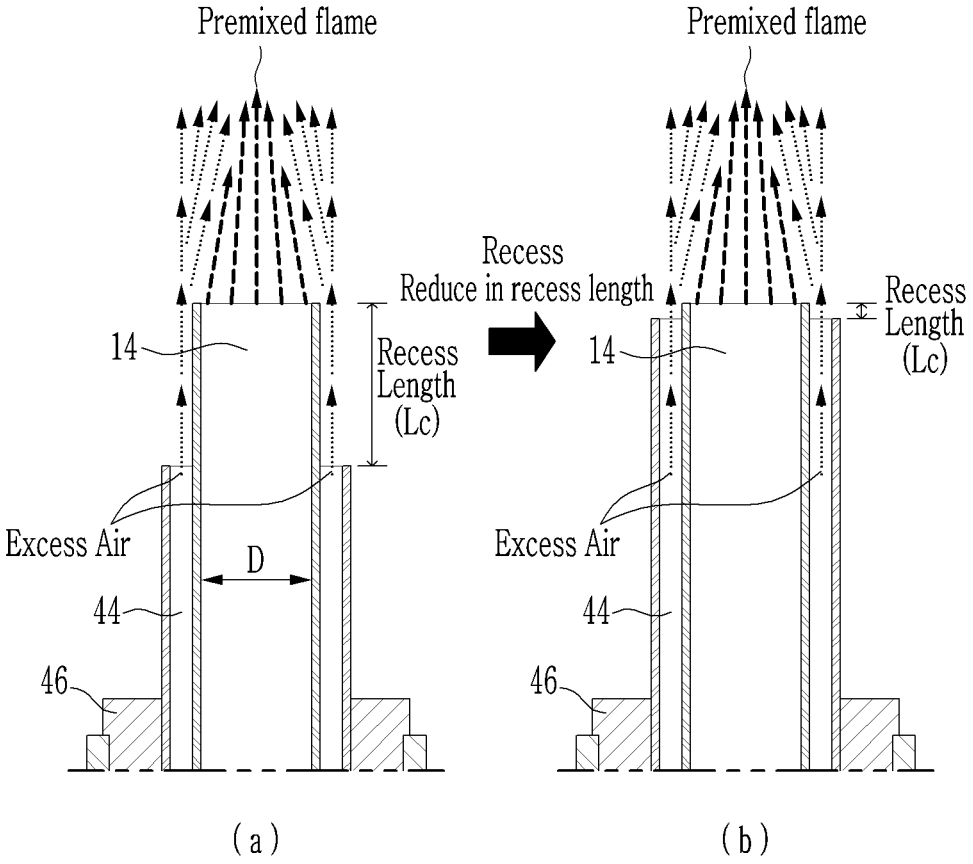
FIG. 7 is a diagram illustrating an appearance of premixed flame according to a difference in a recess length Lc between an end of the outlet of the outer cooling air supply pipe and an end of the outlet the outlet pipe of the plenum chamber of the low Nox premixed hydrogen burner according to the embodiment of the present invention.
Figure 8:
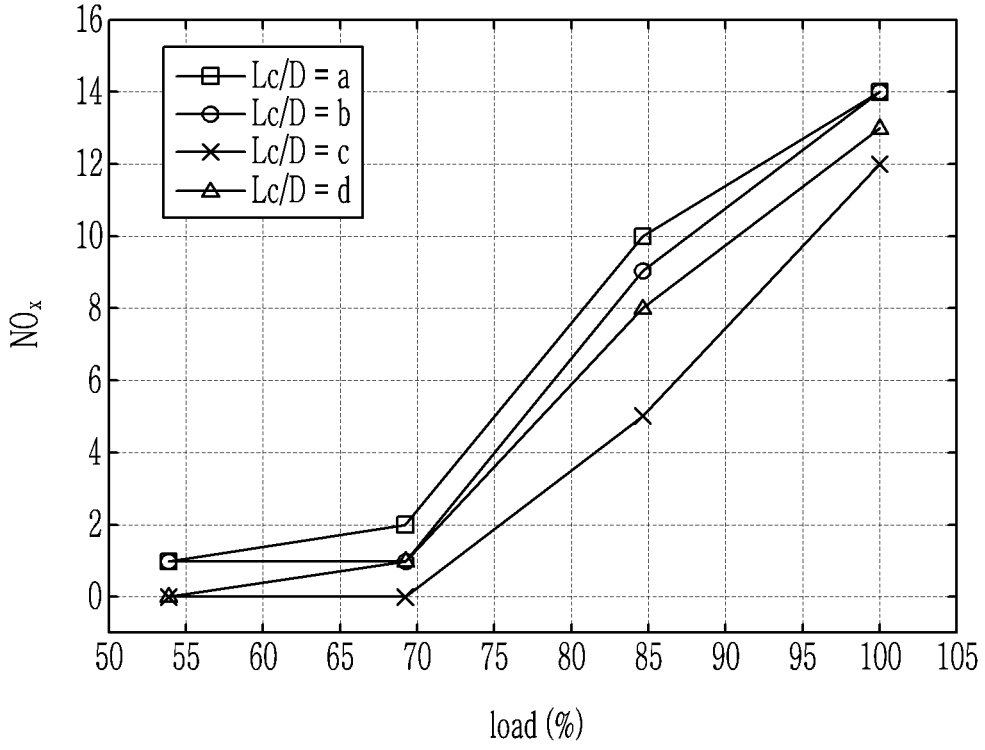
FIG. 8 is a graph illustrating the effect of Nox generation according to the difference in the recess length Lc illustrated in FIG. 7.

FIG. 7 is a diagram illustrating an appearance of premixed flame according to a difference in a recess length Lc between an end of the outlet of the outer cooling air supply pipe and an end of the outlet the outlet pipe of the plenum chamber of the low NOx premixed hydrogen burner according to the embodiment of the present invention, and FIG. 8 is a graph illustrating the effect of NOx generation according to the difference in the recess length Lc illustrated in FIG. 7.

Referring to FIG. 7, the end of the outlet of the outer cooling air supply pipe 40 may be formed to protrude less than the end of the outlet of the outlet pipe 14 of the plenum chamber 10, and the difference in the recess length Lc may be minimized. Further, a diameter of the outlet of the outer cooling air supply pipe 40 may be formed to be from about 15 m/s to about 30 m/s based on the air supply flow velocity.

FIG. 8 is a graph of the amount of NOx generated when the ratio of the difference in a recess length Lc to the diameter D of the outlet pipe 14 is a, b, c, and d, where a is greater than b, b is greater than c, and d is when the end of the outlet of the outer cooling air supply pipe 40 protrudes further than the end of the outlet of the outlet pipe 14 of the plenum chamber 10.

As shown in FIG. 8, under the condition that the diameter D of the outlet pipe 14 of the plenum chamber 10 is the same, it can be seen that the amount of NOx generated is smallest when the ratio of the difference in the recess length Lc to the diameter D of the outlet pipe 14 is c. In other words, it can be seen that the effect of suppressing the formation of hot spots in the premixed flame is improved when the end of the outlet of the outer cooling air supply pipe 40 does not protrude further than the end of the outlet of the outlet pipe 14 of the plenum chamber 10 and the difference in the recess length Lc is minimized.

Figure 9:
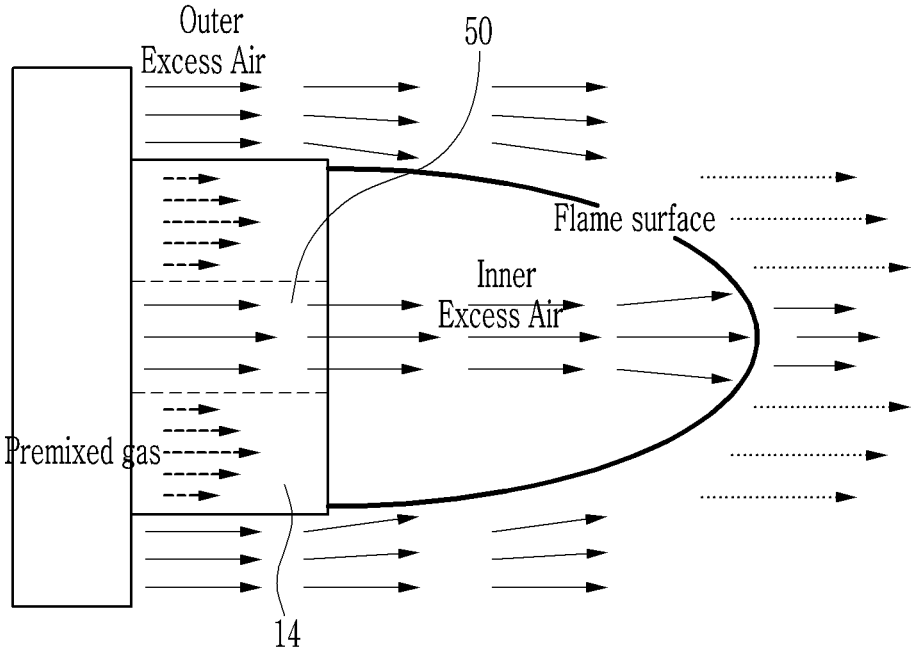
FIG. 9 is a diagram illustrating the state of the premixed flame according to inner and outer cooling air supply of the low Nox premixed hydrogen burner according to the embodiment of the present invention.
Figure 10:
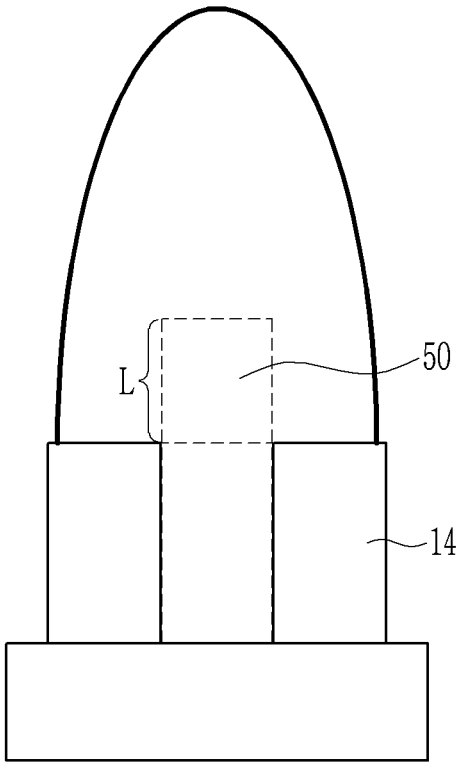
FIG. 10 is a diagram illustrating the state where the inner cooling air supply pipe of the low Nox premixed hydrogen burner according to the embodiment of the present invention protrudes more than the end of the outlet of the outlet pipe of the plenum chamber.

FIG. 9 is a diagram illustrating the state of the premixed flame according to inner and outer cooling air supply of the low NOx premixed hydrogen burner according to the embodiment of the present invention, and FIG. 10 is a diagram illustrating the state where the inner cooling supply pipe of the low NOx premixed hydrogen burner according to the embodiment of the present invention protrudes more than the end of the outlet of the outlet pipe of the plenum chamber.

As shown in FIG. 9, the end of the outlet of the inner cooling air supply pipe 50 may be on approximately the same vertical line as the end of the outlet of the outlet pipe 14 of the plenum chamber 10. The premixed gas discharged from the outlet of the outlet pipe 14 of the plenum chamber 10 forms a triangular-shaped flame surface with respect to the inner center portion. When the premixed gas passes through the flame surface, the premixed gas is combusted to form hot combustion gas. At this point, the flow velocity of the premixed gas and the flame velocity are balanced.

The inner cooling air from the outlet of the inner cooling air supply pipe 50 may directly cool the combustion gas in the high temperature spot of the flame zone. The inner cooling air may efficiently cool with a small flow rate compared to cooling by outer cooling air discharged from the outlet of the outer cooling air supply pipe 40. When the inner cooling air flow rate is too large, the premixed flame may become unstable, so a proper supply flow rate distribution with the outer cooling air flow rate is required.

Meanwhile, the flow velocity and pressure of the inner cooling air in the inner cooling air supply pipe 50 may be formed to be greater than the flow velocity and pressure of the premixed gas at the full load of the hydrogen burner. Otherwise, the inner cooling air may mix with the premixed gas, resulting in degradation of cooling performance.

Referring to FIG. 10, the end of the outlet of the inner cooling air supply pipe 50 may protrude further than the end of the outlet of the outlet pipe 14 of the plenum chamber 10 to cool the flame after flame formation. Mixing of the inner cooling air with the premixed gas changes the equivalence ratio of the premixed gas, which increases the potential for unstable flame formation. The end of the outlet of the inner cooling air supply pipe 50 may be formed to protrude by about one-third or less of the length of the flame than the end of the outlet of the outlet pipe 14 of the plenum chamber 10. Since the closer the end of the outlet of the inner cooling air supply pipe 50 is to the flame surface, the less durable it is and the more thermal fatigue may occur, the end of the outlet of the inner cooling air supply pipe 50 may be formed to protrude for a length less than about one-third of the length of the flame.

Additionally, the end of the outlet of the inner cooling air supply pipe 50 may also be formed in the shape of a diffuser.

FIG. 11 is a diagram illustrating a wake temperature and NOx concentration of the premixed hydrogen burner relative to the hydrogen supplied in the case where the premixed gas is cooled by using only outer cooling air or both outer cooling air and inner cooling air in the low NOx premixed hydrogen burner according to the embodiment of the present invention.

Figure 11A:
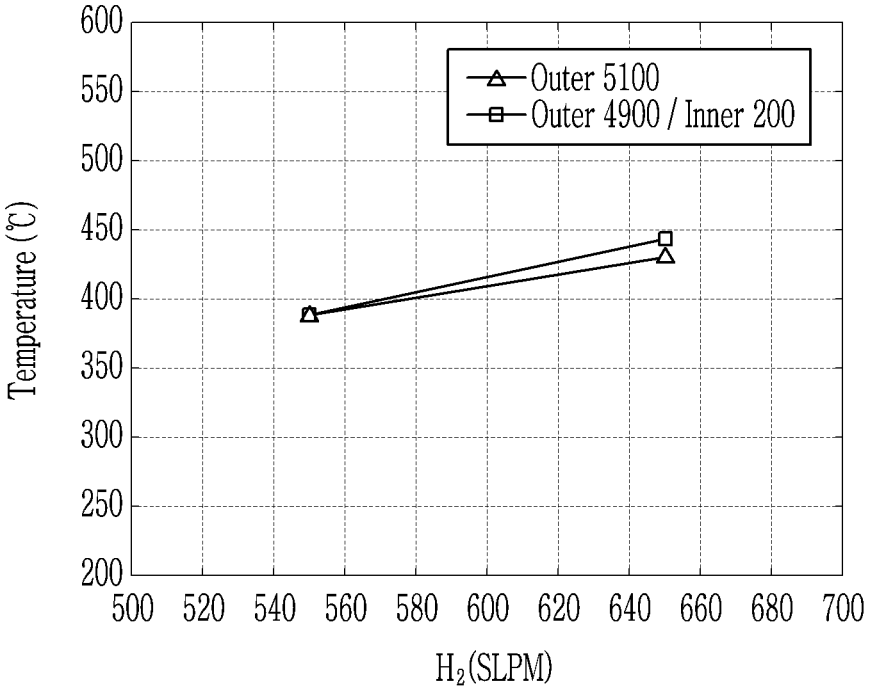
FIGS. 11A and 11B are diagrams illustrating a wake temperature and Nox concentration of the premixed hydrogen burner relative to the hydrogen supplied in the case where the premixed gas is cooled by using only outer cooling air or both outer cooling air and inner cooling air in the low Nox premixed hydrogen burner according to the embodiment of the present invention.

Referring to FIG. 11A, when the case of supplying only outer cooling air is compared with the case of supplying both outer and inner cooling air under the condition of having the same outer cooling air flow rate, the flame wake temperature may be maintained or slightly increased in the latter case.

Figure 11B:
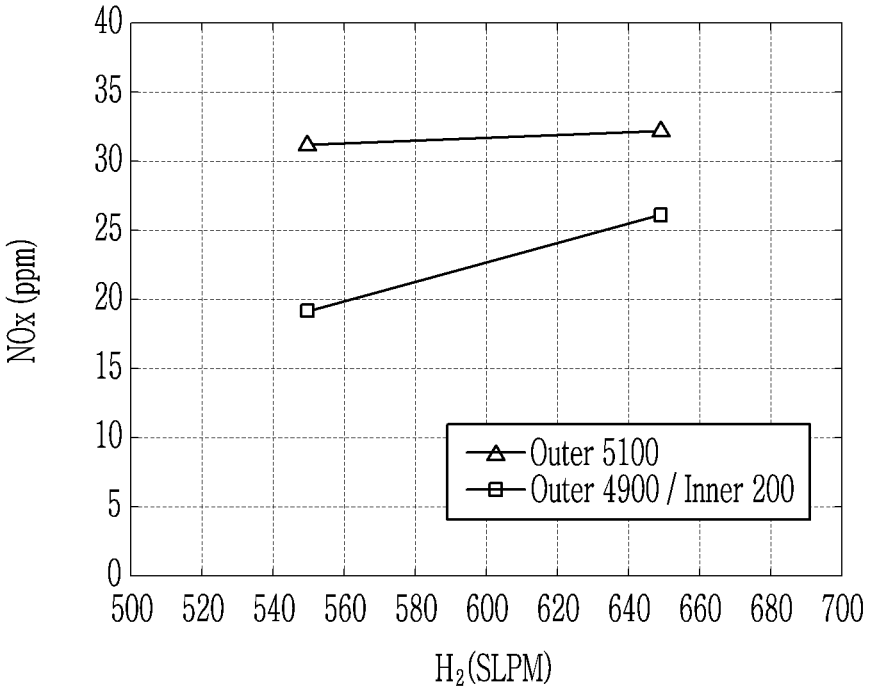

Referring to FIG. 11B, when the case of supplying only outer cooling air is compared with the case of supplying both outer and inner cooling air under the condition of having the same outer cooling air flow rate, it can be seen that in the latter case, more efficient cooling is achieved for the hot areas, resulting in the discharge of the lower concentration of NOx.

FIG. 12 is a diagram illustrating a wake temperature and NOx concentration of the premixed hydrogen burner relative to the cooling air supplied in the case where the premixed gas is cooled by using both outer cooling air and inner cooling air or only outer cooling air in the low NOx premixed hydrogen burner according to the embodiment of the present invention.

Figure 12A:
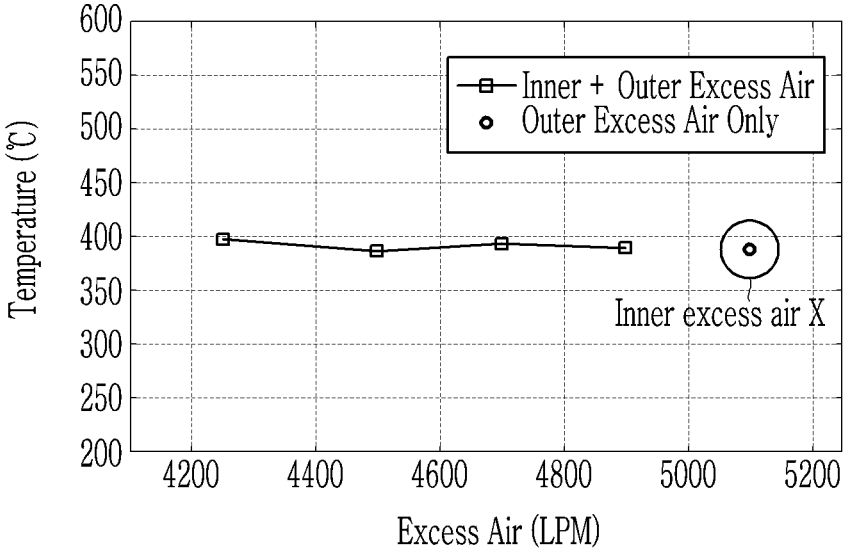
FIGS. 12A and 12B are diagrams illustrating a wake temperature and Nox concentration of the premixed hydrogen burner relative to the cooling air supplied in the case where the premixed gas is cooled by using both outer cooling air and inner cooling air or only outer cooling air in the low Nox premixed hydrogen burner according to the embodiment of the present invention.

Referring to FIG. 12A, under the condition of having the same inner cooling air flow rate, the flame wake temperature may be maintained in both the case where the outer cooling air and the inner cooling air is supplied and the case where only the outer cooling air is supplied.

Figure 12B:
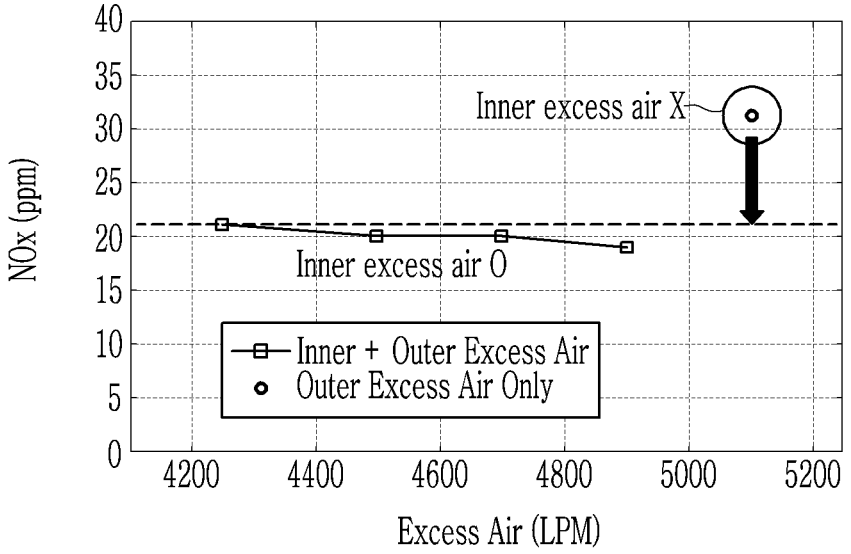

Referring to FIG. 12B, it can be seen that under the condition of having the same inner cooling air flow rate, a higher concentration of NOx is discharged in the case where only the outer cooling air is supplied. Therefore, it can be seen that it is advantageous to supply both external and inner cooling air to cool the premixed gas.

Figure 13:
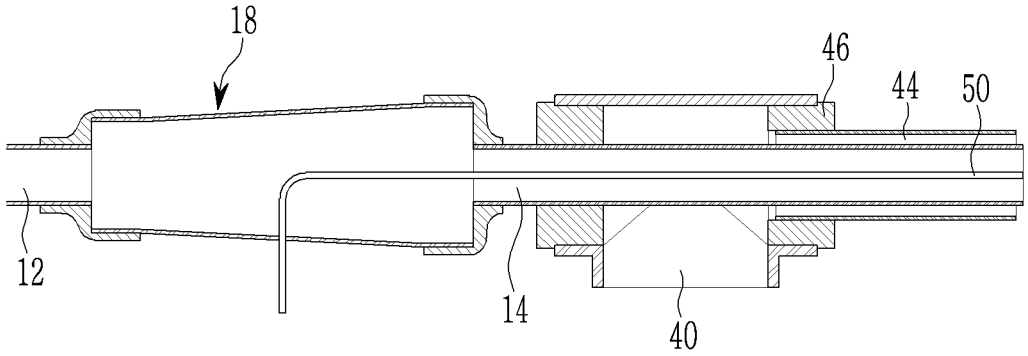
FIG. 13 is a diagram illustrating a plenum chamber of a low Nox premixed hydrogen burner according to another embodiment of the present invention.

FIG. 13 is a diagram illustrating a plenum chamber of a low NOx premixed hydrogen burner according to another embodiment of the present invention.

Referring to FIG. 13, the plenum chamber 18 may be formed in a diffuser type or a nozzle type having a different diameter between the inlet and the outlet. The plenum chamber 18 may be a diffuser type, in which the diameter of the inlet is smaller than the diameter of the outlet, or may be a nozzle type that is the reverse of the diffuser type. The shape of the plenum chamber 18 may be varied for flame stability, in addition to the foregoing shapes.

Figure 14:
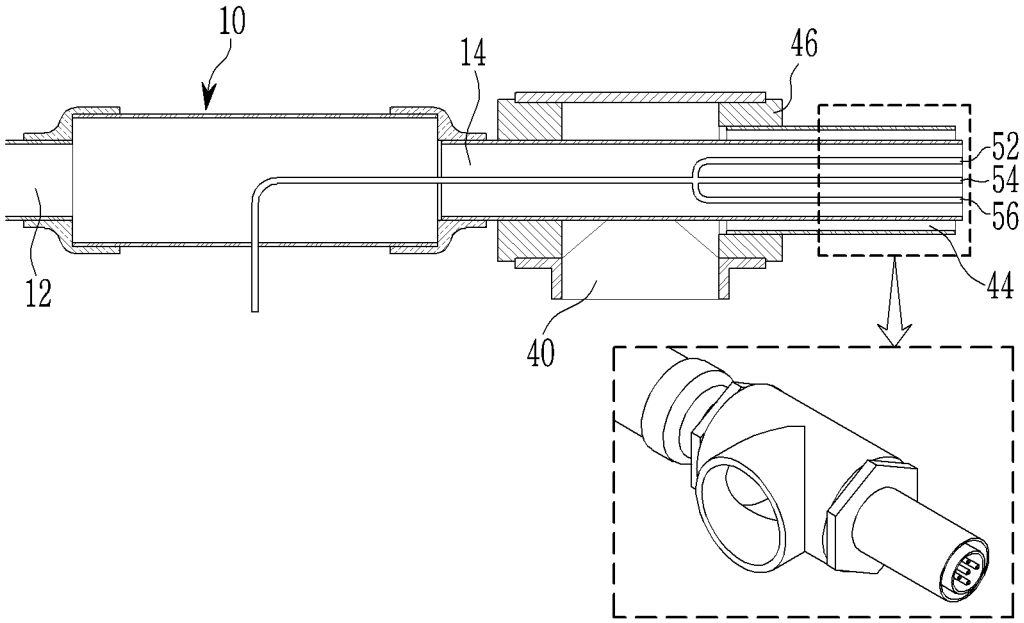
FIG. 14 is a diagram illustrating an inner cooling air supply pipe of the low Nox premixed hydrogen burner according to another embodiment of the present invention.

FIG. 14 is a diagram illustrating an inner cooling air supply pipe of the low NOx premixed hydrogen burner according to another embodiment of the present invention.

As shown in FIG. 14, an inner cooling air supply pipe 50 may include a single inlet and a plurality of outlets. That is, the inner cooling air supply pipe 50 extends into the interior of the plenum chamber 10 from a single inlet, and branches from the outlet pipe 14 of the plenum chamber 10 into a plurality of branch pipes 52, 54, and 56 to form a plurality of outlets. The ends of the plurality of outlets may be formed to be approximately on the same vertical line as the ends of the outlets of the outlet pipe 14 of the plenum chamber 10, or to protrude further than the ends of the outlets of the outlet pipe 14 of the plenum chamber 10.

The inner cooling air supply pipe 50 may be formed as the plurality of branch pipes 52, 54, and 56 within the outlet pipe 14 of the plenum chamber 10, so that more effective cooling of the premixed gas within the outlet pipe 14 of the plenum chamber 10 is possible.

Thus, according to the embodiment of the present invention, it may be possible to improve the mixing performance of the pre-mixture gas, and it is possible to achieve stable combustion by increasing the range of stable combustion, by stabilizing the internal flow and forming a forced vortex within the plenum chamber that generates premixed gas in which hydrogen and combustion air are mixed.

In addition, it may be possible to reduce the flame hot spot and flame length by supplying outer cooling air and inner cooling air through pipes installed around the plenum chamber to cool the premixed flame.

Further, it may be possible to reduce the exposure time of high-temperature areas, thereby reducing the amount of NOx generated.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

| <Description of symbols> | |
|---|---|
| 2: Hydrogen tank | 3: Regulator |
| 4: Hydrogen flow control valve | 5: Metering valve |
| 6: Ignition coil | 7: Igniter |
| 10, 18: Plenum chamber | 12: Inlet pipe |
| 14: Outlet pipe | 20: Hydrogen supply pipe |
| 30: Combust air supply pipe | 32, 42, 52: Blower |
| 40: Outer cooling air supply pipe | 44: Conduit |
| 46: Reducer | 50: Inner cooling air supply pipe |
| 52, 54, 56: Branch pipe | 100: Combustion chamber |

What is claimed is:

1. A low NOx premixed hydrogen burner comprising:

a plenum chamber comprising an inlet pipe and an outlet pipe and configured to mix hydrogen and combustion air introduced through the inlet pipe to generate premixed gas for flame formation, wherein a diameter of the plenum chamber is larger than diameters of the inlet pipe and the outlet pipe, and wherein a length of the plenum chamber is greater than the diameter of the plenum chamber; and an inner cooling air supply pipe installed to extend through an interior of the plenum chamber to the outlet pipe of the plenum chamber, and configured to flow outer cooling air through and cool premixed gas in the plenum chamber;

wherein a flow velocity and pressure of inner cooling air in the inner cooling air supply pipe is formed to be greater than a flow velocity and pressure of hydrogen burner premixed gas at a full load.

2. The low NOx premixed hydrogen burner of claim 1, further comprising:

a hydrogen supply pipe connected to the inlet pipe of the plenum chamber and configured to be supplied with hydrogen; and a combustion air supply pipe connected to the inlet pipe of the plenum chamber, and configured to be supplied with combustion air.

3. The low NOx premixed hydrogen burner of claim 1, further comprising:

an outer cooling air supply pipe connected to the outlet pipe of the plenum chamber and configured to flow outer cooling air along an outer periphery of the outlet pipe to cool the premixed gas discharged from the plenum chamber.

4. The low NOx premixed hydrogen burner of claim 1, wherein the plenum chamber is formed in a cylindrical shape.

5. The low NOx premixed hydrogen burner of claim 1, wherein the plenum chamber has a length-to-radius ratio (AR) of about 6.7 to about 6.9.

6. The low NOx premixed hydrogen burner of claim 1, wherein the plenum chamber has a length-to-radius ratio (AR) of less than about 12.9.

7. The low NOx premixed hydrogen burner of claim 1, wherein a diameter of the plenum chamber is formed to be two times or more than a diameter of an upstream pipe.

8. The low NOx premixed hydrogen burner of claim 1, wherein the plenum chamber is formed in a diffuser-type or nozzle-type with a different diameter between an inlet and an outlet.

9. The low NOx premixed hydrogen burner of claim 3, wherein the outer cooling air supply pipe is installed in an annular shape to surround an outer periphery of the outlet pipe of the plenum chamber.

10. The low NOx premixed hydrogen burner of claim 9, wherein the outer cooling air supply pipe has an inner surface coupled to an outer surface of the outlet pipe of the plenum chamber by a reducer so that cooling air supply is not biased in a particular direction.

11. The low NOx premixed hydrogen burner of claim 9, wherein an end of the outlet of the outlet pipe of the plenum chamber projects over an end of the outlet of the outer cooling air supply pipe by a recess length Lc, which is formed to be minimized.

12. The low NOx premixed hydrogen burner of claim 9, wherein a diameter of an outlet of the outer cooling air supply pipe is formed to generate between about 15 m/s and about 30 m/s of an air supply flow velocity.

13. The low NOx premixed hydrogen burner of claim 1, wherein an end of an outlet of the inner cooling air supply pipe is formed to be on the same vertical line as or to project over an end of the outlet of the outlet pipe of the plenum chamber.

14. The low NOx premixed hydrogen burner of claim 1, wherein an end of an outlet of the inner cooling air supply pipe is formed in a diffuser shape.

15. The low NOx premixed hydrogen burner of claim 1, wherein an end of an outlet of the inner cooling air supply pipe is formed to project by one-third or less of a length of a flame formed from an end of an outlet of the inner cooling air supply pipe over an end of an outlet of the outlet pipe of the plenum chamber.

16. The low NOx premixed hydrogen burner of claim 1, wherein the inner cooling air supply pipe comprises a single inlet and a plurality of outlets.

17. A low NOx premixed hydrogen burner comprising:

a plenum chamber comprising an inlet pipe and an outlet pipe and configured to mix hydrogen and combustion air introduced through the inlet pipe to generate premixed gas for flame formation, wherein an outer cooling air supply pipe is installed in an annular shape to surround an outer periphery of the outlet pipe of the plenum chamber, and wherein an inner cooling air supply pipe is installed to extend through an interior of the plenum chamber to the outlet pipe of the plenum chamber; and an inner cooling air supply pipe installed to extend through an interior of the plenum chamber to the outlet pipe of the plenum chamber, and configured to flow outer cooling air through and cool premixed gas in the plenum chamber;

wherein a flow velocity and pressure of inner cooling air in the inner cooling air supply pipe is formed to be greater than a flow velocity and pressure of hydrogen burner premixed gas at a full load.

18. The low NOx premixed hydrogen burner of claim 17, wherein an end of the outlet of the outlet pipe of the plenum chamber projects over an end of the outlet of the outer cooling air supply pipe, and wherein an end of an outlet of the inner cooling air supply pipe is formed to be on the same vertical line as or to project over an end of the outlet of the outlet pipe of the plenum chamber.

* * * * *